US010680350B2

(12) United States Patent
Sachs et al.

(10) Patent No.: US 10,680,350 B2
(45) Date of Patent: Jun. 9, 2020

(54) METHOD AND CONNECTION DEVICE FOR PRODUCING A CRIMPED CONNECTION

(71) Applicant: TE Connectivity Germany GmbH, Bensheim (DE)

(72) Inventors: Soenke Sachs, Frankfurt (DE); Helge Schmidt, Speyer (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 16/161,473

(22) Filed: Oct. 16, 2018

(65) Prior Publication Data

US 2019/0115673 A1 Apr. 18, 2019

(30) Foreign Application Priority Data

Oct. 16, 2017 (DE) ..... 10 2017 218 486

(51) Int. Cl.

| | |
|---|---|
| ***H01R 4/20*** | (2006.01) |
| ***H01R 43/02*** | (2006.01) |
| ***H01R 4/18*** | (2006.01) |
| ***H01R 43/048*** | (2006.01) |

(52) U.S. Cl.

CPC ..... *H01R 4/20* (2013.01); *H01R 4/187* (2013.01); *H01R 43/0207* (2013.01); *H01R 43/0263* (2013.01); *H01R 43/048* (2013.01)

(58) Field of Classification Search

CPC ..... H01R 4/20; H01R 4/187; H01R 43/0263; H01R 43/048; H01R 43/0221; H01R 43/058; H01R 4/029; H01R 13/422

USPC ..... 439/730

See application file for complete search history.

(56) References Cited

U.S. PATENT DOCUMENTS

| | | | | |
|---|---|---|---|---|
| 4,966,565 | A * | 10/1990 | Dohi | H01R 4/029 439/874 |
| 6,813,826 | B2 * | 11/2004 | Ito | H01R 43/058 29/748 |
| 7,705,265 | B2 * | 4/2010 | Asakura | H01R 43/0221 219/121.64 |
| 9,325,135 | B2 | 4/2016 | Bauer et al. | |
| 10,283,924 | B2 * | 5/2019 | Bauer | H01R 4/187 |
| 2013/0112476 | A1 | 5/2013 | Yabe | |

(Continued)

FOREIGN PATENT DOCUMENTS

| | | | |
|---|---|---|---|
| DE | 10 2007 032 584 | B4 | 11/2008 |
| DE | 102010035424 | A1 | 3/2012 |
| DE | 10 2006 046 350 | B4 | 8/2012 |

(Continued)

OTHER PUBLICATIONS

German Office Action, German Patent Application No. 10 2017 218 486.8, dated Aug. 24, 2018, 8 pages.

(Continued)

*Primary Examiner* — Jean F Duverne
(74) *Attorney, Agent, or Firm* — Barley Snyder

(57) ABSTRACT

A connection device for producing a crimped connection comprises a deformation device and a friction body. The crimped connection includes a crimp sleeve and a conductor. The deformation device is adapted to plastically deform the crimp sleeve around the conductor. The friction body is adapted to be moved into abutment with the crimp sleeve and adapted to be movably driven while remaining in abutment with the crimp sleeve.

20 Claims, 8 Drawing Sheets

(56) References Cited

U.S. PATENT DOCUMENTS

| | | | | |
|---|---|---|---|---|
| 2014/0317922 | A1* | 10/2014 | Schmidt | H01R 13/422<br>29/863 |
| 2015/0082622 | A1 | 3/2015 | Stull | |

FOREIGN PATENT DOCUMENTS

| | | | |
|---|---|---|---|
| JP | 2009-187683 | A | 8/2009 |
| WO | 2016113244 | A1 | 7/2016 |

OTHER PUBLICATIONS

Abstract of DE 10 2007 032 584 B4, dated Nov. 13, 2008, 1 page.
Abstract of DE 10 2006 046 350 B4, dated Aug. 30, 2012, 1 page.

* cited by examiner

METHOD AND CONNECTION DEVICE FOR PRODUCING A CRIMPED CONNECTION

CROSS-REFERENCE TO RELATED APPLICATION

This application claims the benefit of the filing date under 35 U.S.C. § 119(a)-(d) of German Patent Application No. 102017218486.8, filed on Oct. 16, 2017.

FIELD OF THE INVENTION

The present invention relates to a crimped connection and, more particularly, to a crimped connection produced by a connection device.

BACKGROUND

A conductor of a cable can be connected to a contact element by crimping to form a crimped connection. The crimped connection can be improved by being made cohesive, such as by conducting a high current with the crimped connection in order to weld the conductor and the contact element of the crimped connection. Such a welded, cohesive crimped connection, however, can be difficult to produce.

SUMMARY

A connection device for producing a crimped connection comprises a deformation device and a friction body. The crimped connection includes a crimp sleeve and a conductor. The deformation device is adapted to plastically deform the crimp sleeve around the conductor. The friction body is adapted to be moved into abutment with the crimp sleeve and adapted to be movably driven while remaining in abutment with the crimp sleeve.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
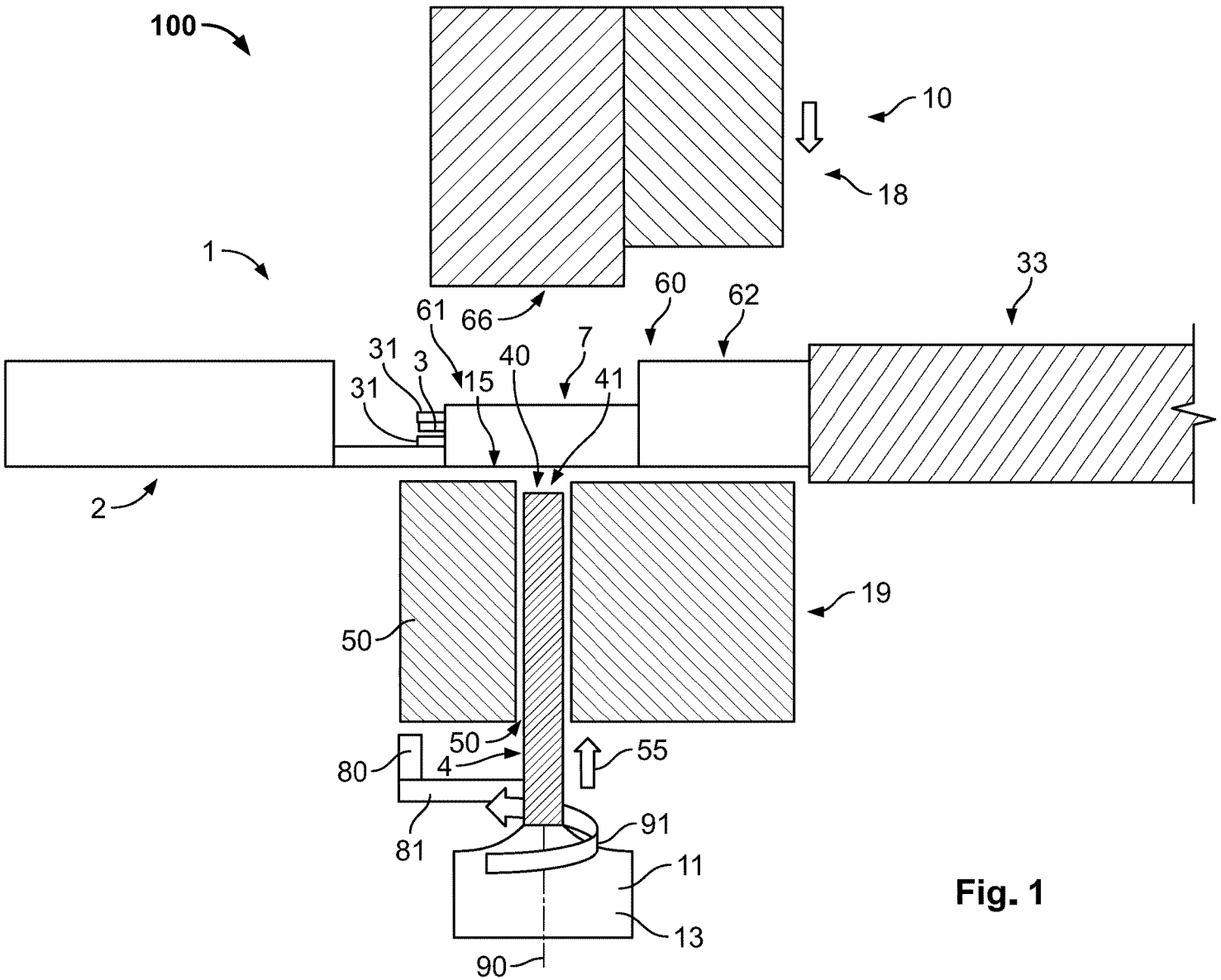
FIG. 1 is a sectional lateral view of a connection device according to an embodiment for producing a crimped connection.
Figure 2:
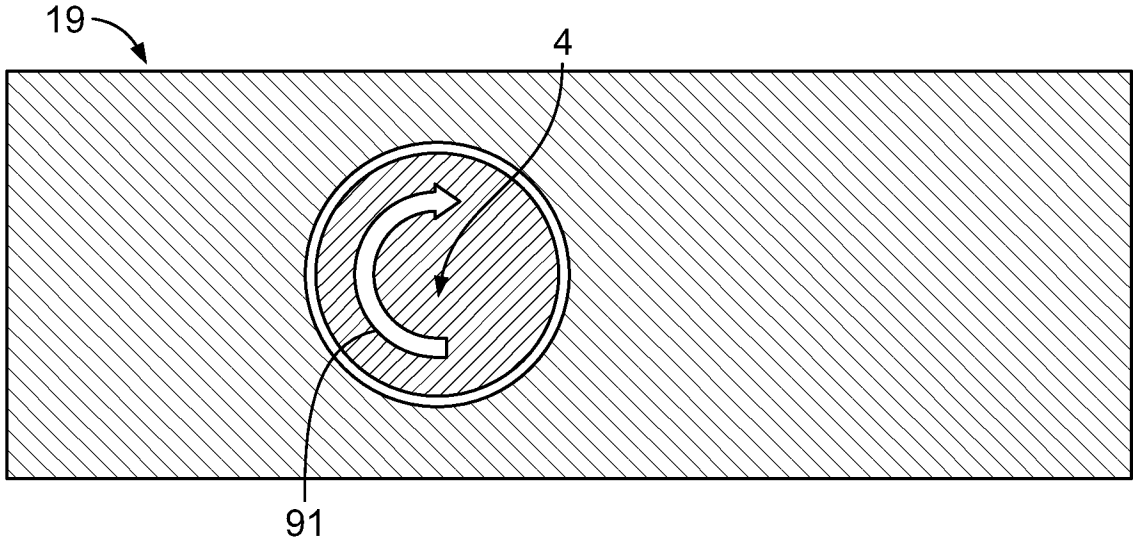
FIG. 2 is a sectional bottom view of the connection device of FIG. 1.

Exemplary embodiments of the present invention will be described hereinafter in detail with reference to the attached drawings, wherein like reference numerals refer to like elements. The present invention may, however, be embodied in many different forms and should not be construed as being limited to the embodiments set forth herein. Rather, these embodiments are provided so that the present disclosure will be thorough and complete and will fully convey the concept of the disclosure to those skilled in the art.

A connection device 100 and method of using the connection device 100 to produce a crimped connection 1 according to an embodiment is shown in FIGS. 1-4.

As shown in FIGS. 1-4, the crimped connection 1 includes a crimp sleeve 2. The crimp sleeve 2, in the shown embodiment, is a contact element having a crimping section 60. The crimping section 60 includes an insulation crimping section 62 and a conductor crimping section 61 at which wings 7 of the crimped connection 1 are plastically deformed around an insulation 34 or a conductor 3 of a cable 33 and subsequently press these inward. In various embodiments, the conductor 3 may be an individual conductor or may consist of a bundle of strands 31.

In order to plastically deform the wings 7, the connection device 100 as shown in FIGS. 1-4 includes a deformation device 10. The deformation device 10 includes a stationary anvil 19 and a ram 18, which is moved during a displacement, with a crimping surface 66 for contacting the wings 7. In order to produce a cohesive connection in the crimped connection 1, the connection device 100 has a friction body 4 that is pressed against the crimped connection 1 and is moved on the crimped connection 1 under friction relative to the crimped connection 1.

In the embodiment shown in FIGS. 1-4, the friction body 4 is rotated along a rotational direction 91 while abutting against the crimped connection 1. A rotational speed of the friction body 4 is independent of a width and a length of the crimped connection 1. In various embodiments, the rotational speed of the friction body 4 may be 500 to 10,000 revolutions per minute or 800 to 5000 revolutions per minute.

The friction between the friction body 4 and the crimped connection 1 generated during the rotation causes frictional heat 5 which results in a cohesive connection inside the crimped connection 1. A solder 70 which is present in the crimped connection 1 can, for example, thus be melted so that, for example, a solder connection arises between various strands 31 of the conductor 3 or between strands 31 and the crimp sleeve 2. Such a solder 70 can, for example, be present as a tin coating at the strands 31 or the crimp sleeve 2. A weld connection can also be produced by the friction generated by the friction body 4. For example, parts of the crimped connection 1, for example the strands 31 or the crimp sleeve 2, can be fused at least on their surfaces. The melted region 21, shown in FIG. 4, can then enter into a cohesive connection with an adjacent region.

As shown in FIG. 1, a pressing device 11 produces a pressing force along a pressing direction 55. The pressing device 11 can also displace the friction body 4 along the pressing direction 55 and thus serve as a displacement device 13. In other embodiments in which the friction body 4 protrudes, a pressing device 11 or a displacement device 13 can also be dispensed with. In order to generate movement, the connection device 100 can have a drive 80 which is connected to the friction body 4 via transmission elements 81 to impart the rotation about the rotational direction 91. The transmission elements 81 may be gears, chains, straps, or the like arranged between the drive 80 and the friction body 4.

In another embodiment, the friction body 4 can be moved to the crimped connection 1 under a translatory movement with the drive 80 as a linear drive. In another embodiment, the movement can be an oscillation movement, such as an ultrasonic movement that oscillates with a frequency of more than 10 kilohertz.

The friction body 4, as shown in FIG. 1, is mounted and guided in a bore 50 in the anvil 19. The drive 80, the transmission elements 81, the pressing device 11 and/or the displacement device 13 can remain stationary and do not have to be moved.

When the friction body 4 is moved into abutment with the crimped connection 1, one friction surface 40, arranged at a front surface 41, of the friction body 4 contacts a base plate 15 of the crimp sleeve 2. The frictional heat 5 resulting from rotation of the friction body 4 along the rotational direction 91 while abutting against the crimped connection 1 is dispersed in the crimped connection 1 by a heat flow 51 shown in FIG. 4.

The friction body 4 can be configured to generate as much frictional heat as possible. The friction surface 40, for example, can be configured to be rough. A particular coating can be present which has a particularly high friction coefficient with a surface which is to be contacted. In order not to be worn by the friction, this coating can also be particularly hard. The friction surface 40 can be configured to be smooth, if material being removed by the movement is to be prevented. The friction surface 40 can be thermally insulated from the rest of the friction body 4, in order to prevent the friction body 4 from heating. The friction surface 40 can consist of a thermally poorly conductive material, for example. The friction surface 40 can be separated from the rest of the friction body 4 by a thermally poorly conductive layer.

In an embodiment, the friction body 4 is moved during the plastic deformation of the wings 7, i.e. during the crimping, in particular just before or during a maximal mechanical pressing. As a result, the cohesive connection can be generated at this precise moment, and mechanical forces can be permanently maintained and provide for a pressing connection in the crimped connection 1.

Figure 4:
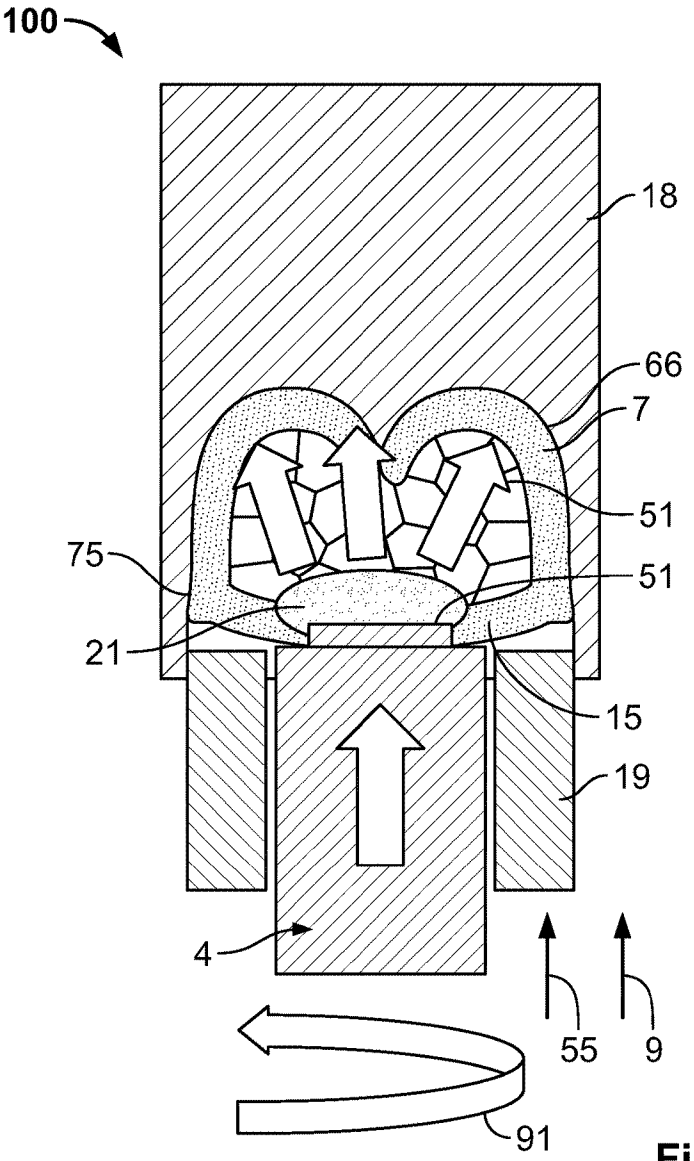
FIG. 4 is a sectional end view of the connection device of FIG. 1 with the friction body in a second position.
Figure 3:
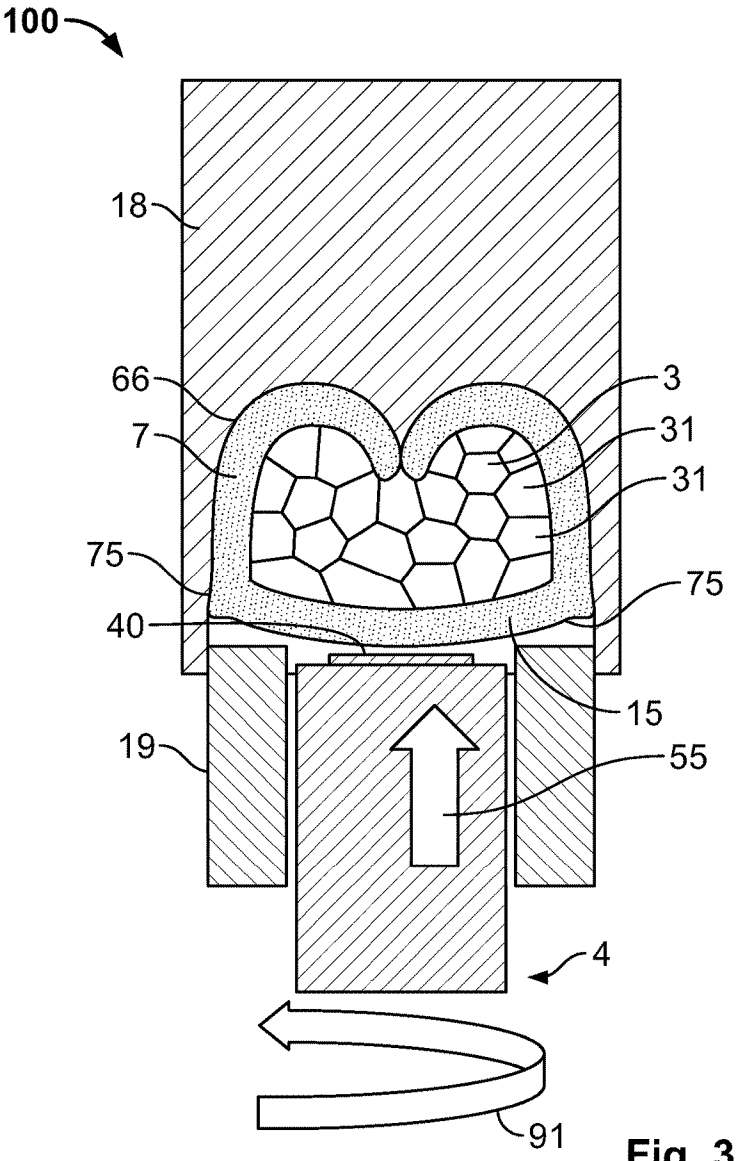
FIG. 3 is a sectional end view of the connection device of FIG. 1 with a friction body in a first position.

As shown in FIGS. 3 and 4, the friction body 4 can be displaced during the frictional movement; the friction body 4, perpendicular to a surface 75 of the base plate 15, is thus displaced into the crimped connection 1. As a result, the contact force between the friction surface 40 and the crimped connection 1 can be sustained even if, for example, parts of the crimped connection soften or melt. In another embodiment, the friction body 4 can be displaced along the surface 75, for example to produce large-scale connections.

Various embodiments of the friction body 4 are shown in FIGS. 5A-5F. The friction bodies 4 are each rotationally symmetrical about a longitudinal axis 90, about which the friction body 4 is rotated during operation along the rotational direction 91. The friction surfaces 40 are each arranged at a front surface 41 of the friction body 4. The friction body 4 can have a holding section at which the friction body 4 is held by the connection device 100. The holding section can be configured as a drive section at which the friction body 4 can be driven or is driven. In order to be rotated easily, the holding section or the drive section can be molded to be cylindrical or conical. The friction body 4 can have a friction section, at which the friction surface 40 is arranged. The friction section can be different from the holding section and the drive section. The friction section can be increased relative to the holding section and/or the drive section, in order to enable a large friction surface 40. The friction section can have approximately the same cross-section as or a smaller cross-section than the holding section and/or the drive section, in order to facilitate an insertion and replacement of a back side.

Figures 5A, 5B, 5C, 5D, 5E, 5F:
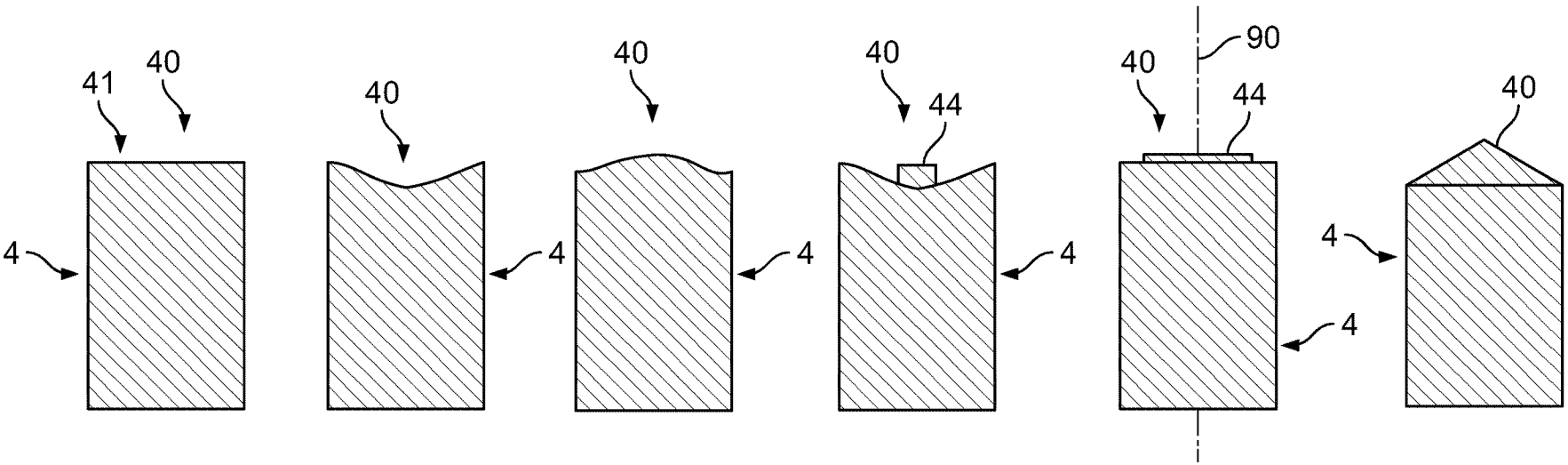
FIG. 5A is a sectional lateral view of an embodiment of a friction body.
FIG. 5B is a sectional lateral view of another embodiment of a friction body.
FIG. 5C is a sectional lateral view of another embodiment of a friction body.
FIG. 5D is a sectional lateral view of another embodiment of a friction body.
FIG. 5E is a sectional lateral view of another embodiment of a friction body.
FIG. 5F is a sectional lateral view of another embodiment of a friction body.

FIG. 5A shows a configuration in which the friction surface 40 is configured to be flat. It is a circular surface which, for example, can be used well with flat surfaces. The friction surface 40 can run perpendicular to the longitudinal axis 90. In FIGS. 5B and 5C, the friction surface 40 is configured to be concave or convex, in order to cooperate with a correspondingly configured mating surface. In FIGS. 5D and 5E, central elements 44 are in each case present which, for example, can help to position the friction body 4. Furthermore, the friction surface 40 is increased in size by said central elements 44 and a greater frictional heat is thereby generated. The configuration shown in FIG. 5F with a conical friction surface 40 can be inserted in the embodiment according to FIGS. 6 and 7, as described in greater detail below, and penetrate into a region between the wings 7 by way of a tip of the conical friction surface 40. The conical friction surface 40 allows a large frictional surface with small lateral dimensions.

Figure 6:
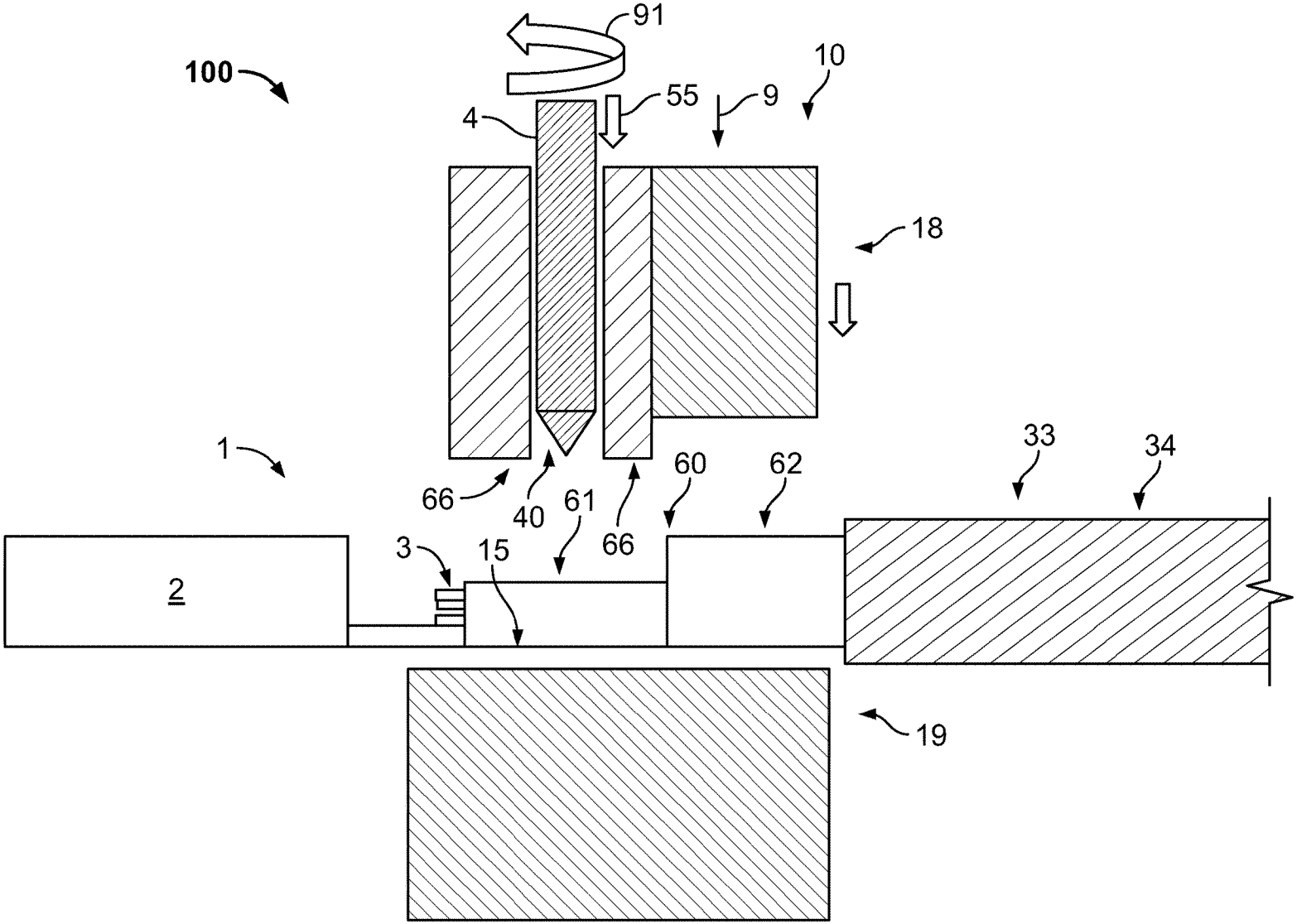
FIG. 6 is a sectional lateral view of a connection device according to another embodiment for producing a crimp connection.
Figure 7:
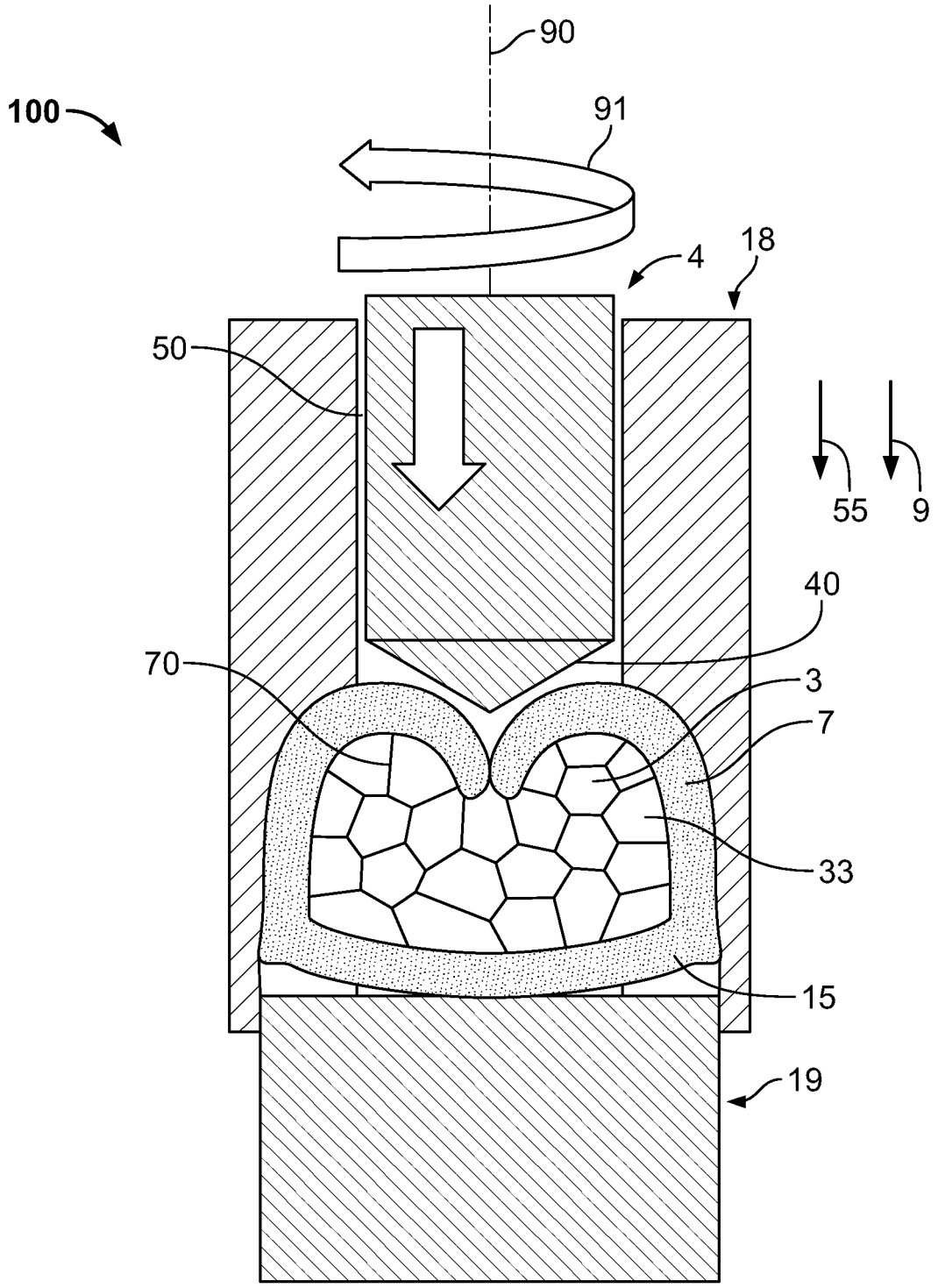
FIG. 7 is a sectional end view of the connection device of FIG. 6.
Figure 8D:
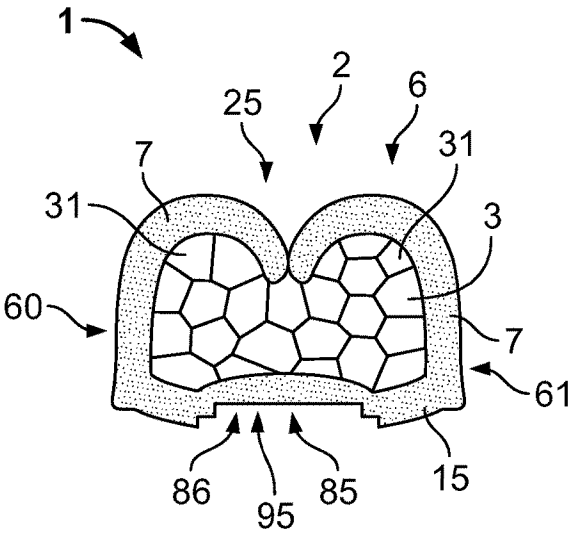
FIG. 8D is a sectional end view of the crimped connection taken along line D-D of FIG. 8B.
Figure 8A:
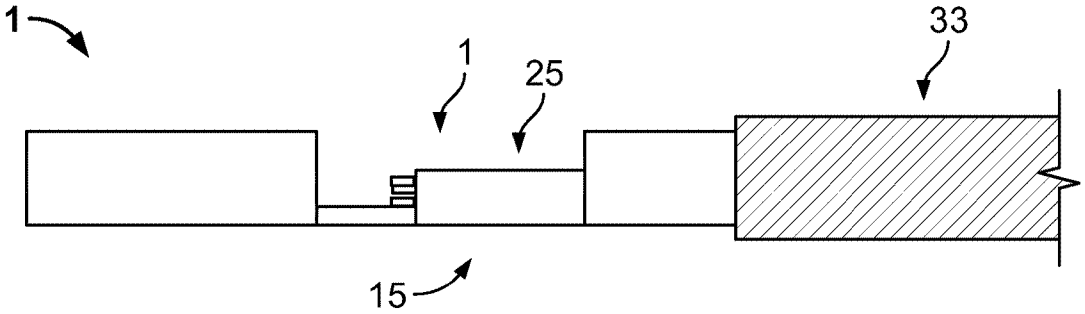
FIG. 8A is a sectional lateral view of a crimped connection produced with the connection device of FIG. 1.
Figure 8B:
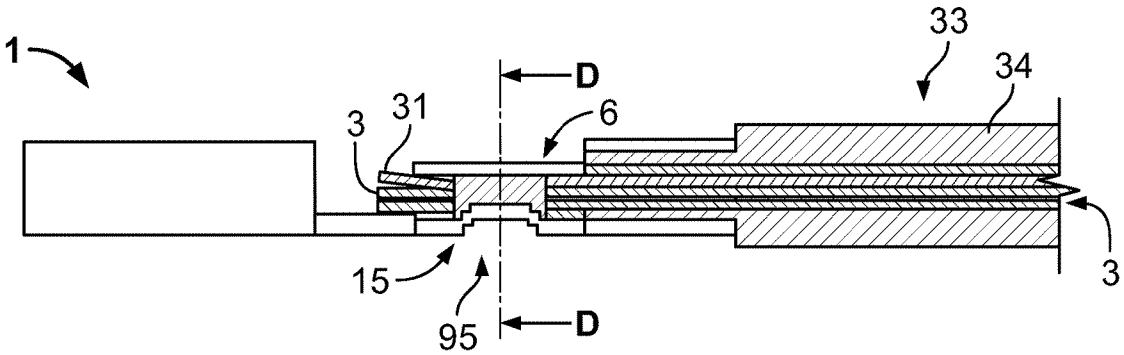
FIG. 8B is another sectional lateral view of the crimped connection of FIG. 8A.
Figure 8C:
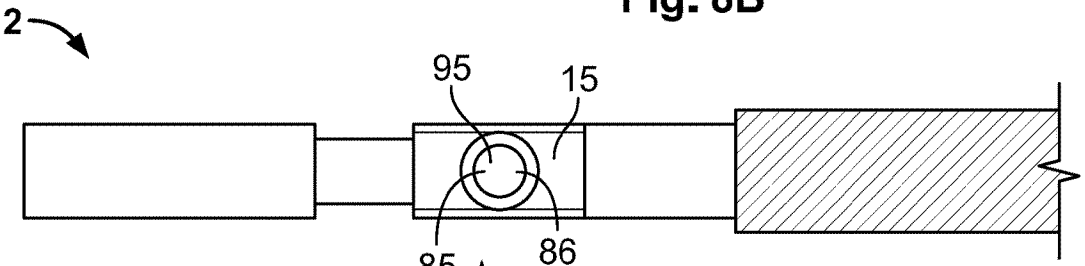
FIG. 8C is a sectional bottom view of the crimped connection of FIG. 8A.
Figure 9D:
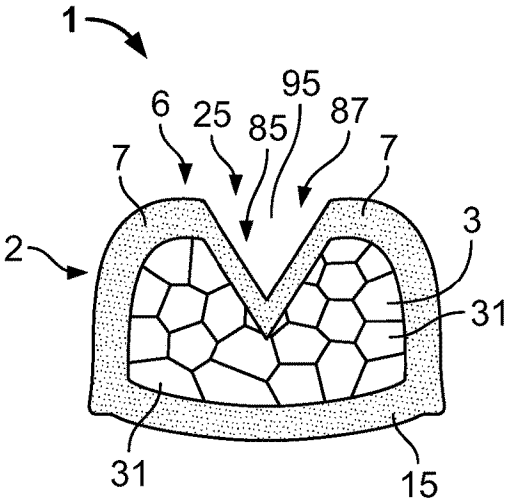
FIG. 9D is a sectional end view of the crimped connection taken along line D-D of FIG. 9B.
Figure 9A:
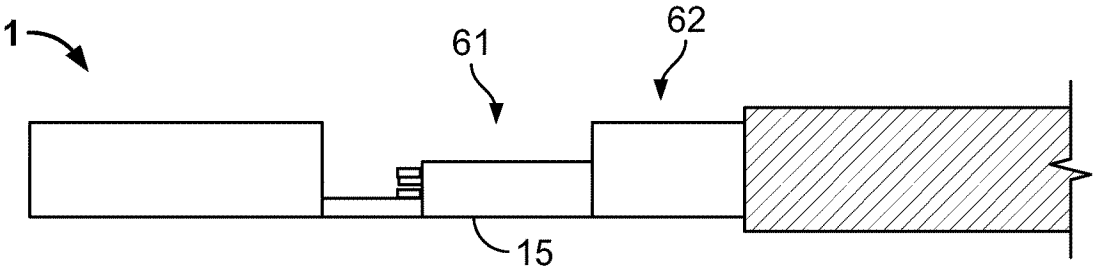
FIG. 9A is a sectional lateral view of a crimped connection produced with the connection device of FIG. 6.
Figure 9B:
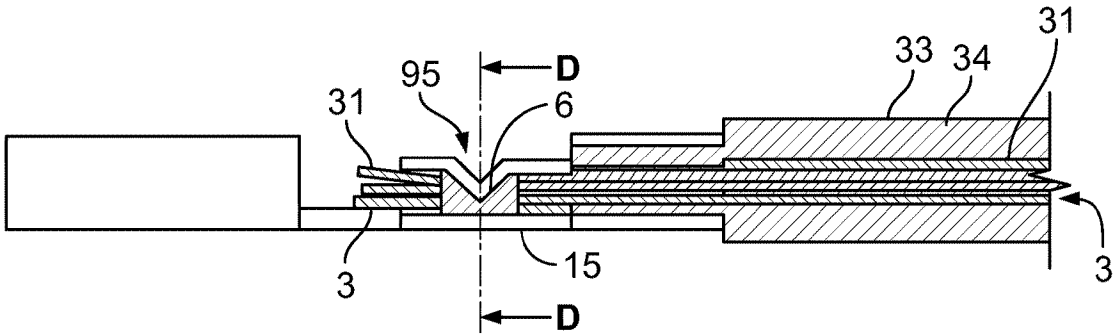
FIG. 9B is another sectional lateral view of the crimped connection of FIG. 9A.
Figure 9C:
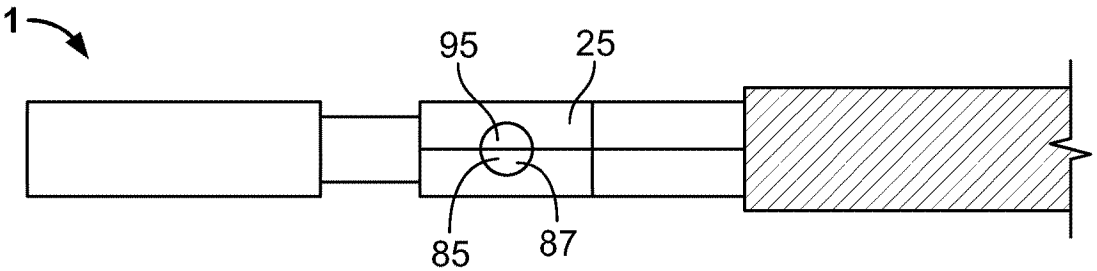
FIG. 9C is a sectional bottom view of the crimped connection of FIG. 9A.

A connection device 100 according to another embodiment is shown in FIGS. 6 and 7. Like reference numbers refer to like elements and only the differences from the connection device 100 shown in FIGS. 1-4 will be described in detail herein. In the embodiment shown in FIGS. 6 and 7, the friction body 4 is mounted and guided in the ram 18 of the deformation device 11. By way of the rotation, the wings 7 of the crimped connection 1 can be heated and connected to one another, for example by an existing solder 70, or by melting and welding. The friction body 4 can be resiliently mounted in the ram 18, in order to ensure that a contact between the friction body 4 and the crimped connection 1 is always produced, even in the case of production-related inaccuracies regarding size.

FIGS. 8A to 8D show a crimped connection 1 produced by the connection device 100 shown in FIGS. 1-4 and the friction body 4 shown in FIG. 5E. A recess 85, in the shown embodiment, is located in a base plate 15 of the crimped connection 1 and is caused by the rubbing and pressing of the friction body 4 against the crimped connection 1. The used configuration of the friction body 4 results in a tiered cylindrical recess 86. Inside the conductor crimping section 61, a weld connection 6 is present which was achieved by the frictional heat. The individual strands 31 of the conductor 3 can be welded to one another and to the conductor crimping section 61. The wings 7 can also be welded to one another by the frictional heat. The recess 85 simultaneously depicts a frictional stamp 95 at which it is possible to detect the frictional movement of the friction body 4, for example by way of stress marks.

FIGS. 9A to 9D show a crimped connection 1 produced by the connection device 100 shown in FIG. 6 and the friction body 4 shown in FIG. 5F. The crimped connection 1 has a recess 85 which has resulted from rubbing and pressing the friction body 4. However, in this embodiment, the recess 85 is located at an upper side 25 which is opposite the base plate 15. Parts of the wings 7 form the recess 85. In this embodiment, the recess 85 is a conical recess 87 which was caused by the use of the conical friction body 4. A weld connection 6 is also present here, which again connects the individual strands 31 to one another or to the conductor crimping section 61. Furthermore, the wings 7 can also be welded to one another. Here too, the recess 85 simultaneously depicts a frictional stamp 95, with the help of which it can be demonstrated that the crimped connection 1 was produced with a method according to the invention.

What is claimed is:

1. A method for producing a crimped connection, comprising:

plastically deforming a crimp sleeve around a conductor;

pressing a friction body against the crimp sleeve; and moving the friction body with friction against the crimp sleeve in order to generate a cohesive connection between the conductor and the crimp sleeve, the friction body is rotated relative to the crimp sleeve while remaining in contact with the crimp sleeve to generate the cohesive connection.

2. The method of claim 1, wherein the moving step takes place during the plastically deforming step.

3. The method of claim 1, wherein the moving step takes place just before or during a maximal mechanical pressing of the plastically deforming step.

4. The method of claim 1, wherein at least a part of the crimped connection is heated by a frictional heat generated during the moving step.

5. The method of claim 4, wherein a weld connection between the conductor and the crimp sleeve is produced by the frictional heat.

6. The method of claim 1, wherein a pair of wings of the crimp sleeve are heated and connected by the moving step.

7. The method of claim 1, wherein the moving step includes displacing the friction body with force against the crimp sleeve.

8. The method of claim 5, wherein the frictional heat generated during the moving step melts a portion of each of a plurality of strands of the conductor.

9. The method of claim 8, wherein the strands of the conductor are fused within the crimped connection to from the cohesive connection.

10. The method of claim 5, wherein the frictional heat generated during the moving step melts a solder disposed in the crimped connection.

11. The method of claim 10, wherein the solder connects a plurality of strands of the conductor to form the cohesive connection within the crimped connection.

12. The method of claim 11, wherein the solder is a coating on each of the strands.

13. The method of claim 10, wherein the solder is a coating on the crimp sleeve.

14. A connection device for producing a crimped connection including a crimp sleeve and a conductor, comprising:

a deformation device adapted to plastically deform the crimp sleeve around the conductor; and a friction body adapted to be moved into abutment with the crimp sleeve and rotated relative to the crimp sleeve while remaining in abutment with the crimp sleeve to generate a cohesive connection between the crimp sleeve and the conductor.

15. The connection device of claim 14, wherein the friction body is mounted in an anvil of the deformation device.

16. The connection device of claim 14, wherein the friction body is mounted in a ram of the deformation device.

17. A crimped connection, comprising;

a conductor; and a crimp sleeve plastically deformed around the conductor by a deformation device of a connection device and cohesively connected to the conductor by a friction body of the connection device, the friction body adapted to be moved into abutment with the crimp sleeve and rotated relative to the crimp sleeve while remaining in abutment with the crimp sleeve to generate a cohesive connection between the crimp sleeve and the conductor.

18. The crimped connection of claim 17, wherein the crimp sleeve is welded to a bundle of strands of the conductor.

19. The crimped connection of claim 17, wherein the crimp sleeve has a frictional stamp generated by the friction body.

20. The crimped connection of claim 17, wherein the crimp sleeve has a recess generated by the friction body at a base plate of the crimp sleeve and/or at an upper side of the crimp sleeve.

* * * * *